US008215790B2

(12) United States Patent
Hesse et al.

(10) Patent No.: US 8,215,790 B2
(45) Date of Patent: Jul. 10, 2012

(54) LIGHT-EMITTING PRODUCT

(75) Inventors: Bryan L. Hesse, Guilford, CT (US); John Rotondo, Trumbull, CT (US); Michael L. O'Banion, Westminster, MD (US); Joseph Paul, Thomaston, CT (US); David Mathieu, Colchester, CT (US)

(73) Assignee: The Gillette Company, Boston, MA (US)

( * ) Notice: Subject to any disclaimer, the term of this patent is extended or adjusted under 35 U.S.C. 154(b) by 106 days.

(21) Appl. No.: 12/960,594

(22) Filed: Dec. 6, 2010

(65) Prior Publication Data

US 2011/0075406 A1 Mar. 31, 2011

Related U.S. Application Data

(63) Continuation of application No. 12/241,311, filed on Sep. 30, 2008, now Pat. No. 7,914,169.

(60) Provisional application No. 60/977,142, filed on Oct. 3, 2007.

(51) Int. Cl.
*F21L 4/00* (2006.01)

(52) U.S. Cl. ..... 362/187; 362/188; 362/197; 362/199; 362/205; 362/208

(58) Field of Classification Search ..... 362/187, 362/188, 197, 199, 205, 206, 208
See application file for complete search history.

(56) References Cited

U.S. PATENT DOCUMENTS 4,821,156 A * 4/1989 Siefert et al. ..... 362/187
5,499,172 A * 3/1996 Shiau ..... 362/187
7,114,832 B2 * 10/2006 Holder et al. ..... 362/308

OTHER PUBLICATIONS

Hall, "Wii-powered robot chair is for toddlers, piloted by toddlers". http://dvice.com/archives/2010/11/wii-powered-rob.php; dated Nov. 19, 2010; accessed Dec. 1, 2010.

* cited by examiner

*Primary Examiner* — Stephen F Husar
*Assistant Examiner* — James Cranson, Jr.
(74) *Attorney, Agent, or Firm* — Fish & Richardson P.C.

(57) ABSTRACT

A light-emitting product (for example, a flashlight) includes a first housing includes a light source for emitting light and a lens system that is adjustable in position relative to the light source. The second housing can be attached to the first housing and includes a power source for the light source. When the first housing and the second housing are attached, the first housing and the second housing can be moved relative to each other to adjust the position of the lens system relative to the position of the light source to focus the light from the light source.

32 Claims, 7 Drawing Sheets

LIGHT-EMITTING PRODUCT

CROSS-REFERENCE TO RELATED APPLICATION

This application is a CON of 12/241,311, filed Sep. 30, 2008, U.S. Pat. No. 7,914,169 WHICH CLAIMS BENEFIT OF 60/977,142 FILED Oct. 3, 2007.

TECHNICAL FIELD

This invention relates to light-emitting products such as flashlights.

Flashlights generally include a light source that can be focused in some manner. Historically, some flashlights included a reflector but not a lens. The light beam emitted from these flashlights often could be adjusted by altering the relative position of the reflector and the light source. This has been accomplished using mechanisms that either move the reflector relative to the light source or move the light relative to the reflector. For example, a head assembly including a light source might be screwed onto a flashlight body including the reflector, or vice versa, and turning the head assembly would move the light source and the reflector relative to each other.

Often types of flashlights do not include a reflector but do include a lens system including one or more lenses that can be used for focusing. Focusing in these flashlights involve altering the relative position of the lens system and the light source. This generally has been accomplished by (1) fixing the position of the lens system in the head assembly and moving the lens system relative to a light source fixed in the flashlight body when the head assembly is screwed onto the body, (2) mounting the lens system in a housing that is moved relative to a light source by a mechanism analogous to those found on some video projectors, or (3) using a fixed head assembly including a lens system and a light source that can be moved relative to the lens system by rotating a ring. In a commercial version of the third design the head assembly is not detachable from the flashlight body.

Another known flashlight includes a fixed reflector, a fixed light source, a movable lens system, and a motor that moves the lens system for focus.

SUMMARY

In one aspect, the invention features a light-emitting product, such as a flashlight, that includes a first housing and a second housing that can be attached to the first housing. The first housing includes a lens system fixed in position within the first housing, a reflector also fixed in position within the first housing, and a lens system that is adjustable in position relative to the light source and the reflector. The second housing includes a power source, such as a battery, for the light source. When the first housing and the second housing are attached they can be moved relative to each other to adjust the position of the lens system relative to the position of the light source to focus the light from the light source. By using a first housing that employs both a light source, a reflector and a lens, a large amount of the light from the light source can be collimated and the light beam can be focused over a broad band (a tight to wide beam). The light-emitting device is easy to focus and relatively cost effective to manufacture.

In some embodiment, the first housing and the second housing include opposing threaded surfaces that allow the first housing to be attached to the second housing and that allow the adjustment of the position of the lens system after attachment. The latter adjustment can be made, for example, by including an element in the lens system that contacts the second housing to provide the adjustment to the position of the lens system. The lens system can be spring loaded in the front housing.

In some embodiments, the first housing further includes a heat sink that absorbs and dissipates heat generated by the light source. The light source can be mounted on the heat sink, which because it absorbs and dissipates heat from the light source minimizes the tolerance stack-up between parts.

Embodiments of the light-emitting product may include one or more of the following features. The first housing may include one or more elements that extend rearward to contact a cam surface. When the first housing is moved relative to the second housing the element through contact with the cam surface adjusts the position of the lens system relative to the light source. The cam surface may be cylindrical, as in a barrel cam. The cam surface may be located on a cup or other member that is fixed in position relative to the second housing. The cup or other member may include an external element, for example, a tooth that engages a surface of the second housing and fixes the cup or other member in position relative to the second housing. The second housing may include a surface (for example, an internal surface) having a protruding element (for example, a spline) that engages the cup or other member and fixes the cup in position relative to the second housing. The cam surface may include a stop element (for example, a vertical step) that prevents the element extending rearward from the first housing from moving further along the cam surface In another aspect the invention features a light-emitting product the same as one of these described above but without a reflector in the first housing.

In another aspect, the invention features any of the first housings described above. In some embodiments, the first housing can be attached to a variety of second housings including a power source including, for example, a housing of a bicycle pack, head light, flashlight, etc. In other embodiments, the first housing can be used with multiple power sources, such as small or large battery packs, a rechargeable or non-rechargeable battery pack, or an AC powered system.

Other aspects of the invention include methods of assembly and methods of using the above light-emitting devices.

A "reflector" as used herein, is a member that includes a surface having a reflectance of greater than 50%, e.g., greater than about 75% of the visible light generated by the light source.

Among other advantages of one or more embodiments is a configuration which allows a user to manipulate (e.g., widen or narrow) a light beam by relative rotation of components, but is prevented from rotating the components to an extent that the components separate or move beyond a predetermined range of motion.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
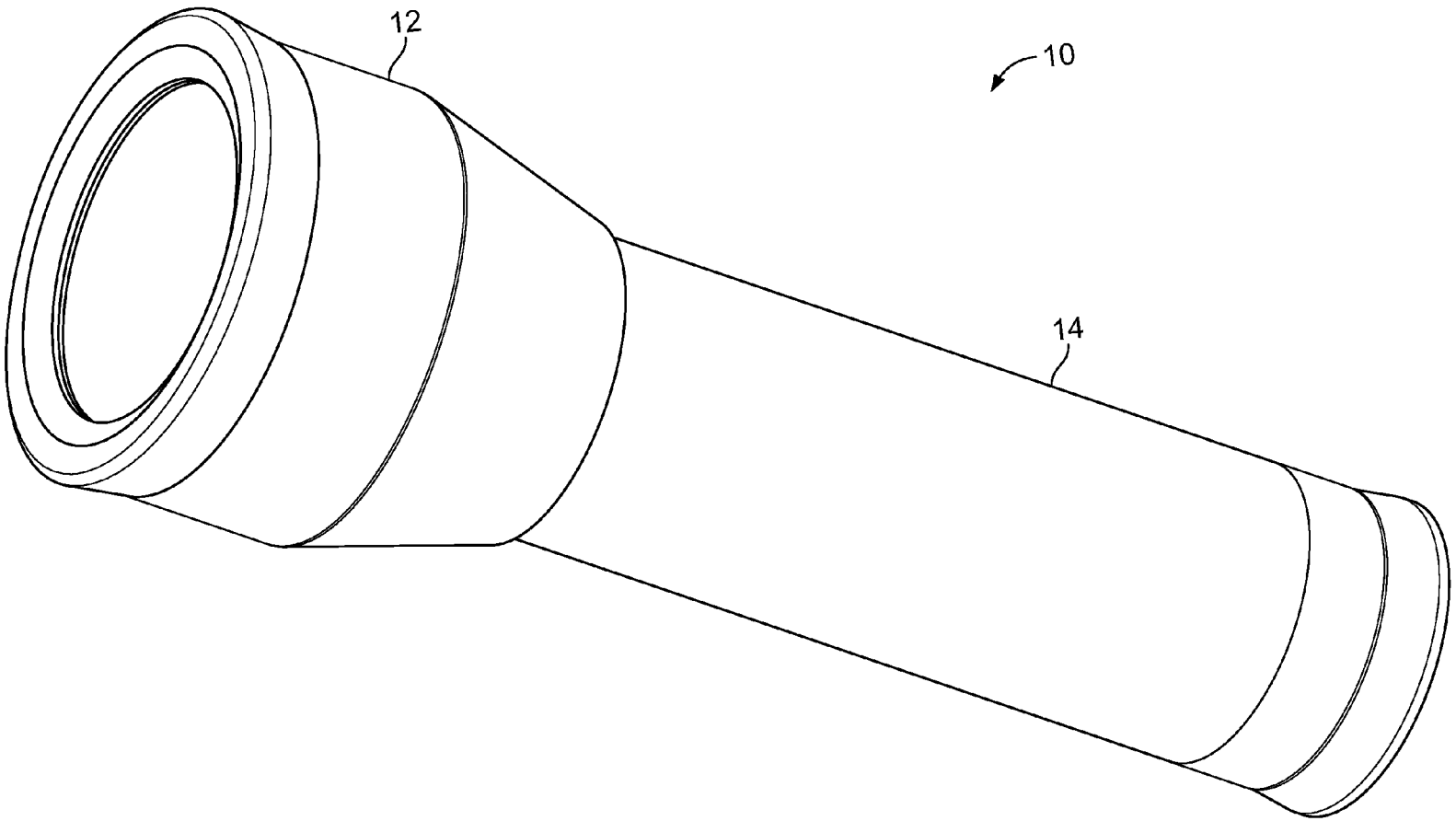
FIG. 1 is a is a perspective view of an embodiment of a light-emitting device.

Referring to FIG. 1, a flashlight 10 includes a front, first housing 12 and an elongated rear, second housing 14.

Figure 2:
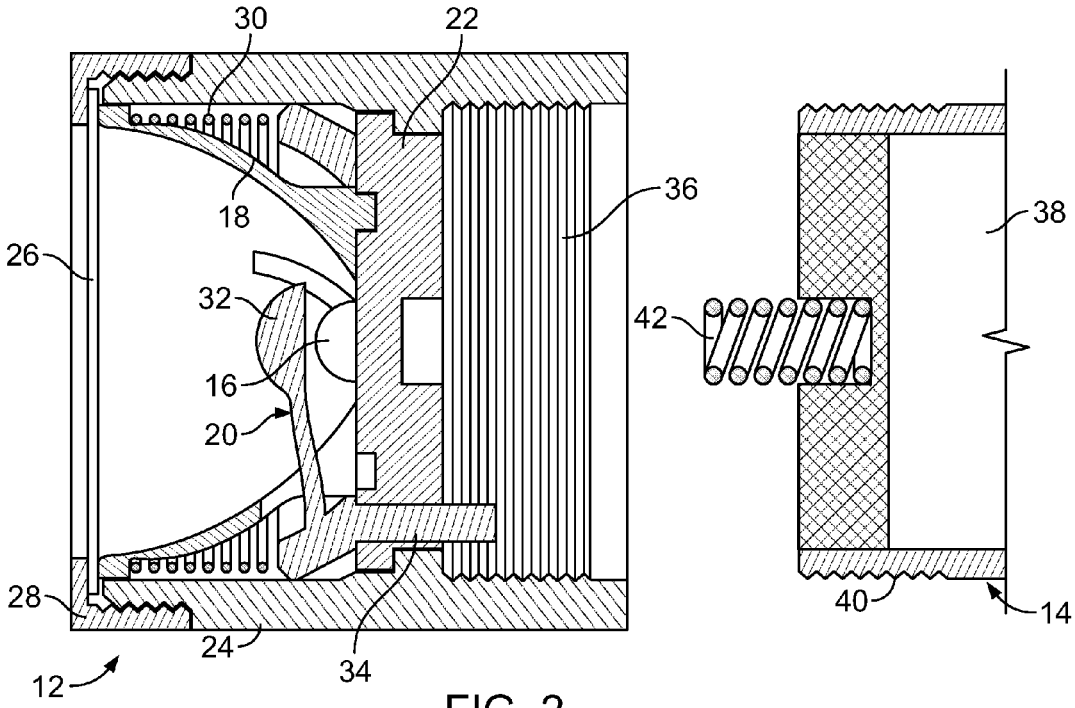
FIG. 2 is a sectional view of the first housing and the front of the second housing in the light-emitting device in FIG. 1, detached.

Referring to FIG. 2, first housing 12 includes a light source 16, a reflector 18, a lens system 20, a heat sink 22, an outer head 24, a window 26, an end cap 28, and a lens spring 30.

Light source 16 is an LED but alternatively can be, for example, an incandescent bulb. Light source 16 is mounted on heat sinks 22 and is fixed in position in first housing 12.

Reflector 18 can be made of, for example, a solid single material such as a polished metal like aluminum, copper or silver, or a coated material such as metal (e.g., aluminum) coated glass or plastic. Reflector 18 also is mounted on heat sink 22 and is fixed in position in first housing 12.

Lens system 20 includes a lens 32, extending in front of light source 16, and member 34. Lens 32 is configured to collimate, focus, or widen light emitted by light source 16, based on the relative positions between lens 32 and light source 16. In one embodiment, lens 32 has a rounded front surface and a flat rear surface focusing light source 16. Lens system 20 is movable relative to light source 16 and reflector 18 (see further discussion below). Lens system 20 alternatively can include a plurality of lenses that, together, collimate, widen, or focus light from light source 16.

Heat sink 22 can be made of materials such as, e.g., aluminum, copper, or a heat conducting-composite, that absorb and dissipate heat from light source 16. Heat sink 22 is fixed to outer head 24.

Outer head 24 includes a threaded surface 36. Outer head 24 can be constructed from metal, plastic, or other material. Member 34 overlaps axially with threaded surface 36. Window 26 is mounted at the front of first housing 12 and detachable end cap 28 is attached to outer head 24.

Lens spring 30 is mounted between reflector 18 and lens assembly 20 adjacent to the front of member 24.

Second housing 14 includes a chamber 38 for batteries (not shown), a threaded surface 40, and an electrical contact, which in this embodiment is a spring 42, between the batteries and light source 16 when first housing 12 and second housing 14 are attached.

Figure 3:
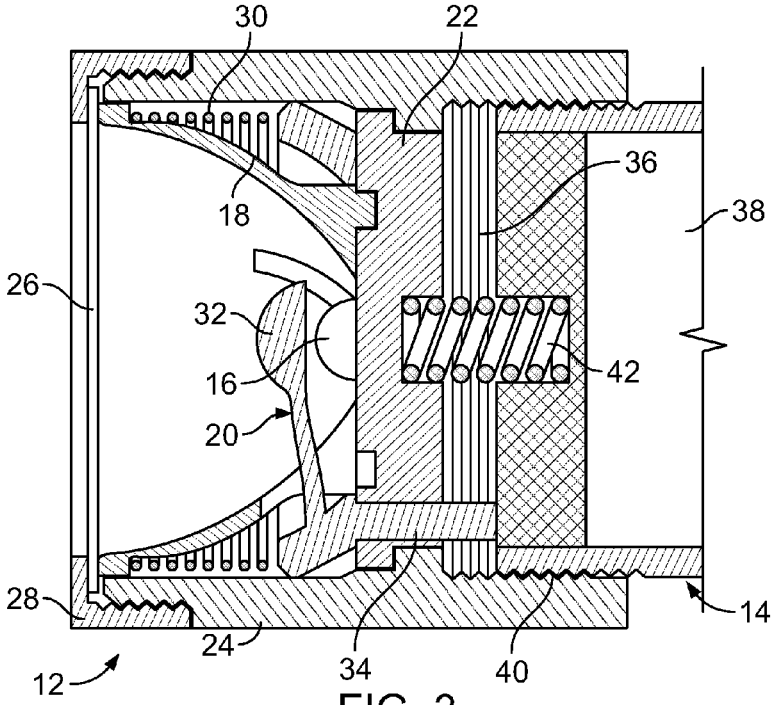
FIGS. 3-5 are sectional views of the first housing and the front of the second housing in the light-emitting device in FIG. 1, attached.
Figure 4:
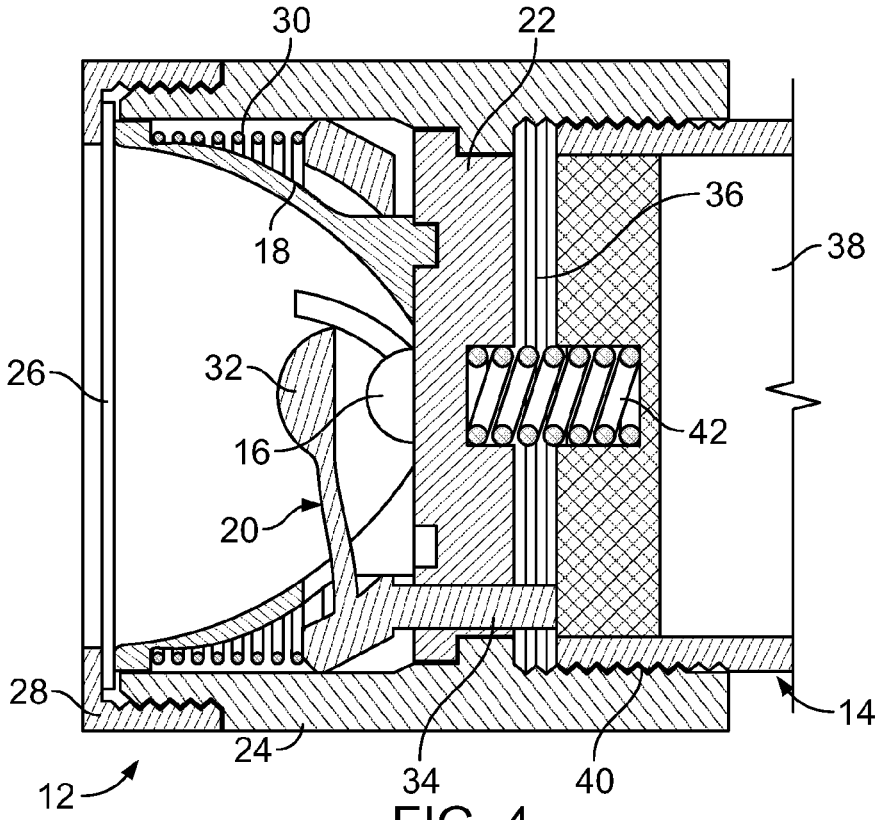
Figure 5:
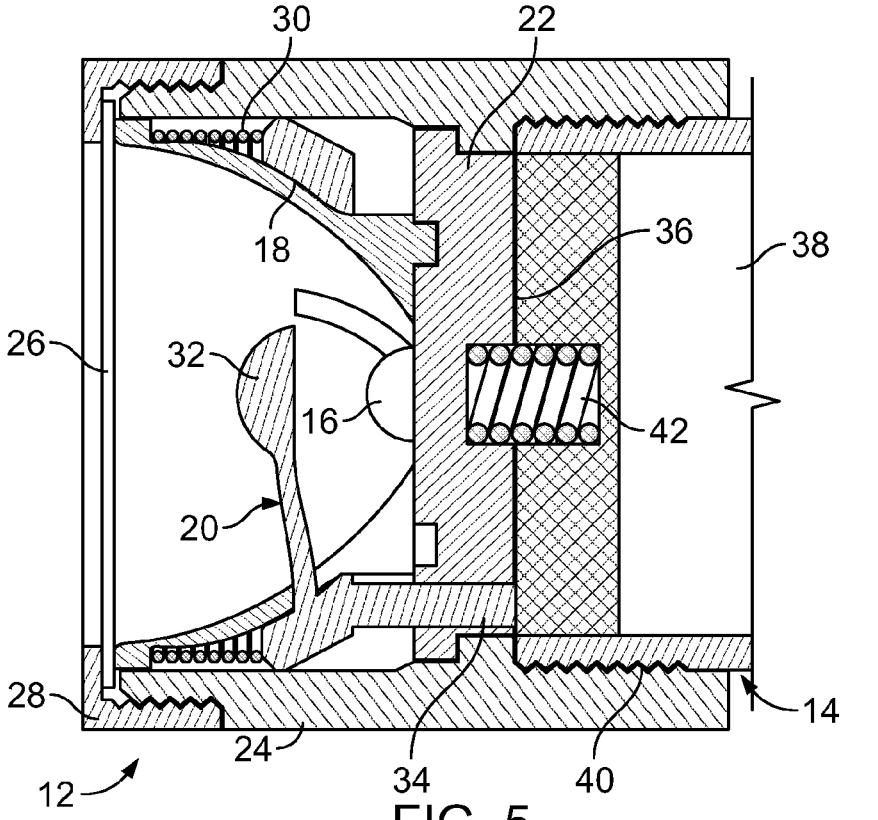

First housing 12 and second housing 14 are shown detached in FIG. 2. Referring to FIGS. 3-5, first housing 12 and second housing 14 are attached by screwing first housing 12 onto second housing 14. Eventually, member 34 contacts the front of second housing 14. At that point, lens 32 is at its closest position to light source 16. As first housing 12 continues to be screwed onto second housing 14, light source 16 and reflector 18 continue to move axially towards second housing 14, but further axial movement of lens system 20 is constrained by the contact of member 34 with the front of second housing 14. As a result, the front of member 34 compresses lens spring 30 which causes lens 32 to move further away from light source 16. This results in focusing a light beam emitted from light-emitting device 16 (with end cap 28 detached) to focus from a wide beam to a narrower beam. When first housing 12 is fully screwed onto second housing 14 (see FIG. 5), lens 32 is at its furthest distance from light source 16.

In use, first housing 12 is rotated relative to second housing 14 to provide the desired focus. Of course, this can also be done by rotating second housing 14 relative to first housing 12.

Figure 6:
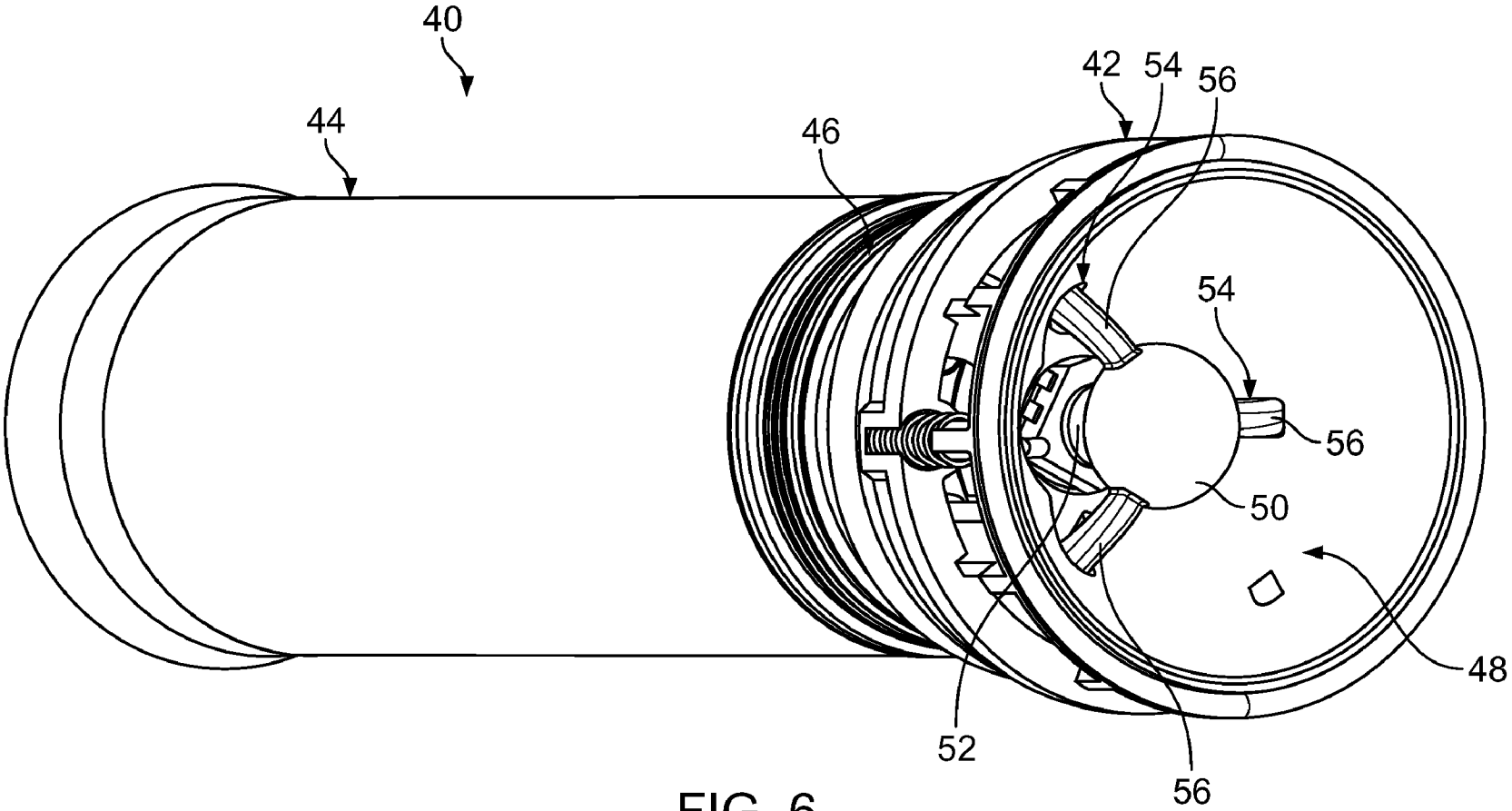
FIG. 6 is a front perspective view, partially in cutaway, of a second embodiment of a light-emitting device.

Referring to FIG. 6, in an alternative embodiment a flashlight 40 includes a front, first housing 42 and a rear, second housing 44 attached by means of threaded surfaces including threaded surface 46 on rear housing 44. First housing 42 includes a statically mounted reflector 48, a clear focusing lens 50 located centrally on the distal side of reflector 48, and a light source 52 at the apex of reflector 48 proximal to lens 50. Reflector 48 has one or more (e.g., two, three or four) radially distributed openings 54. Lens 50 includes one or more radially distributed legs 56 protruding through reflector to a proximal position.

Figure 7:
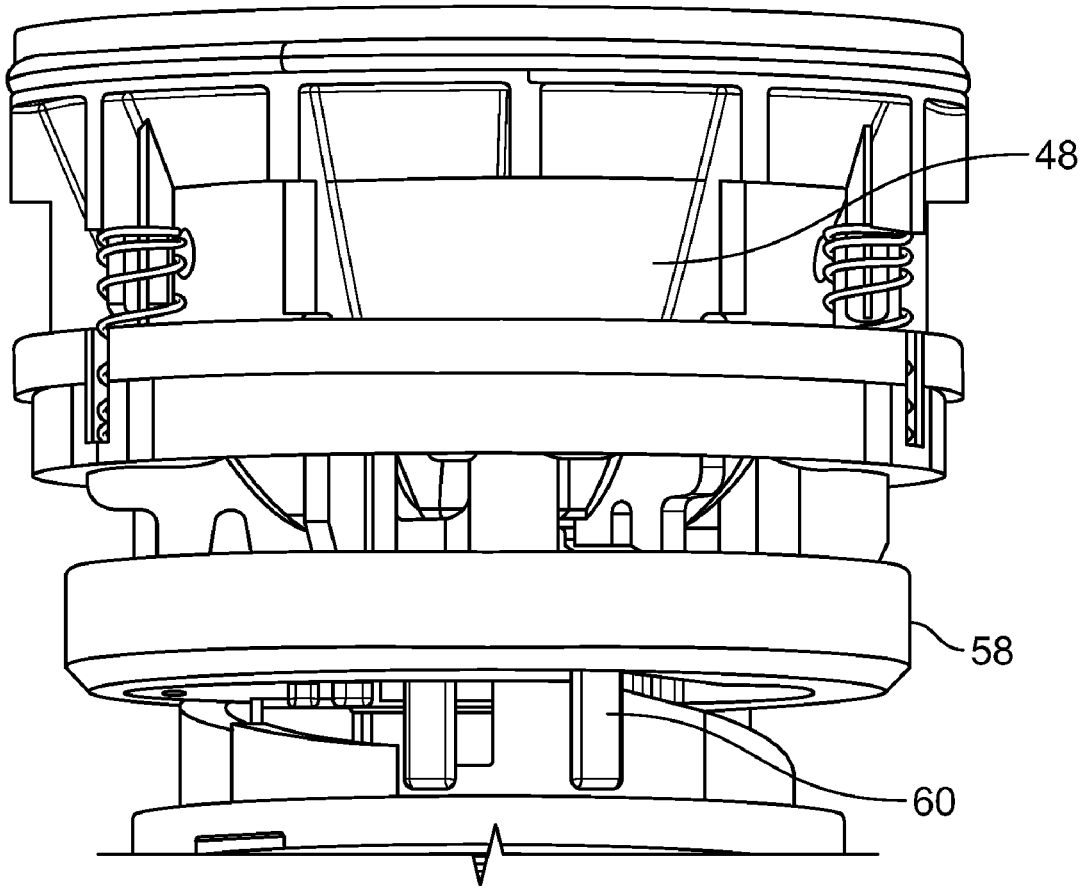
FIG. 7 is a rear side view, partially in cutaway, of the front end of light-emitting device of FIG. 6.

Referring to FIG. 7, reflector 48 is rotationally and axially constrained to a heat sink 58. Heat sink 58 has axial legs 60 radially displaced from the position of openings 54.

Figure 8:
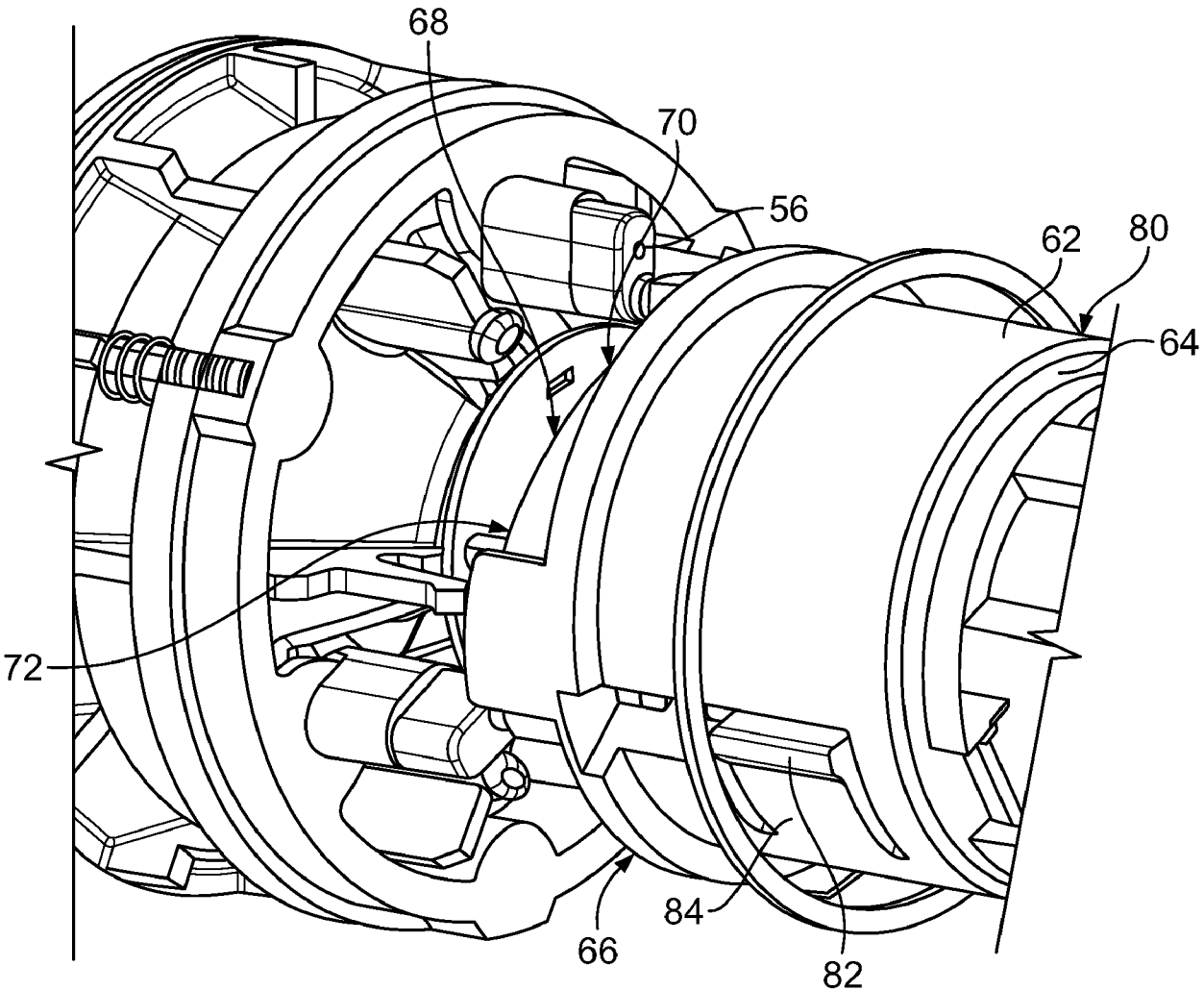
FIG. 8 is a rear perspective view, partially in cutaway, of the light-emitting device of FIG. 6 mated to the front-end of the rear housing with alternative type of cam surfaces.

Referring to FIG. 8, a cup 62 with a planar circular proximal end 64 is located proximal to light source 52. Cup 62 includes an annular distal end 66 including one or more helical cam surfaces 68. Helical cam surfaces 68 communicates with legs 56 of lens 50. By means of relative rotation of first housing 42 to cam surface 68 lens 50 is moved in an axial direction from a proximal to distal position relative to light source 52, thereby causing a change in the light beam from narrow to wide angle.

Cam surface 68 has a proximal end 70 and a distal end 72. At distal end 72 cam surface 68 returns to proximal end 70 with a nearly vertical step 74, shown in FIG. 9. When a right hand thread is used on first housing 42, step 74 on cam surface 68 will face in such a direction such that clockwise rotation of first housing 42 causes cup 62 to also rotate in a clockwise direction. The relative adjustment of lens 50 in this embodiment is such that the axial movement due to the helical travel of the thread is subtractive to the axial cam travel.

Figure 9:
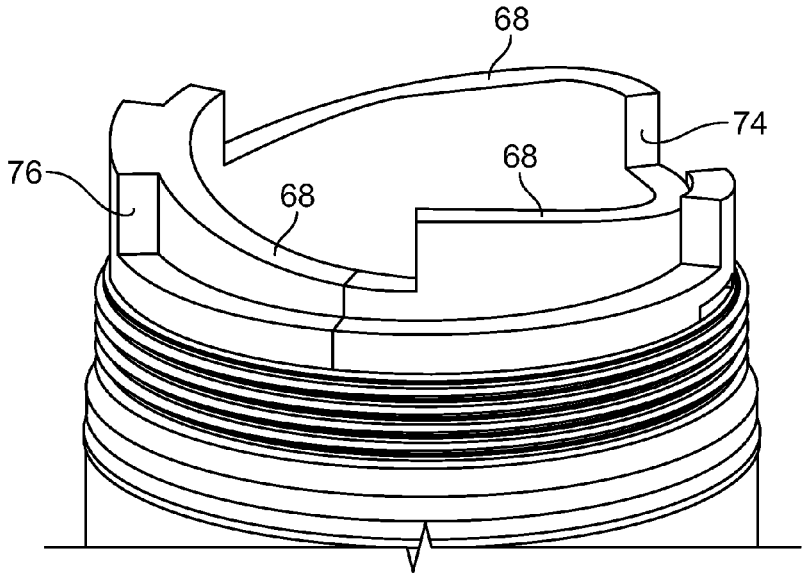
FIG. 9 is a side view of the front end of the rear housing of the light-emitting device of FIG. 6, with alternative types of cam surfaces.

Referring to FIG. 9, a function of substantially vertical step 74 alternatively can be accomplished with a substantially vertical step 76 on cup 62 but separated radially from the cam. In this embodiment, cup 62 rotates in a clockwise direction due to engagement with axial legs 60 of heat sink 58. The relative adjustment of lens 50 in this embodiment may be such that the axial movement due to the helical travel of the thread is additive to the axial cam travel.

Figure 10:
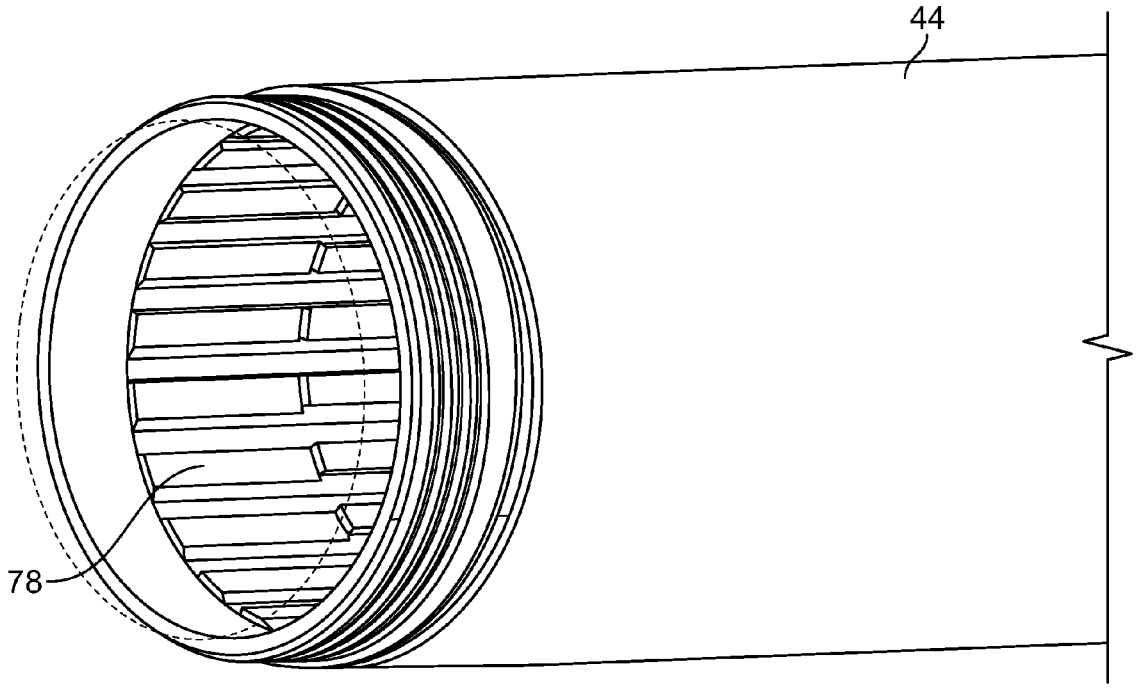
FIG. 10 is a front perspective view of the front of the rear housing of the light-emitting device of FIG. 6, without the cup.

Referring to FIG. 10, second housing 44 has a generally cylindrical internal surface including one or more splines 78 extending at least a portion of the length of the tube.

Referring back to FIG. 8, cup 62 has an external surface 80 interrupted with at least one radially protruding tooth 82. Tooth 82 is connected to cup 62 via a compliant member 84. Compliant member 84 allows compliance in a radial direction but is relatively non-compliant in a rotational direction. Tooth 82 further preferably is more compliant in a clockwise direction and less compliant in a counterclockwise direction.

Flashlight 40 can be assembled as follows. Cup 62 is affixed to first housing 42 prior to and during assembly but eventually becomes locked in portion relative to second housing 44. First housing 42 is screwed on to second housing 44 by means of the threaded surface 46. As first housing 42 progresses through its helical movement following the thread helix, legs 56 come to a stop against substantially vertical step 74 on cup 62. This causes cup 62 to rotate with and in the same helical direction as first housing 42. As first housing 42 and cup 62 further progress in the helical path, external tooth 82 on cup 62 engages internal spline 78 of second housing 44. Further rotation of first housing 42 and cup 62 causes the tooth 82 to compliantly ratchet over spline 78. The final movement of front housing 42 comes to a stop at the finish of assembly with the threads fully engaged. Legs 56 are now located at the bottom proximal end of cam surface 68. Tooth 82 of cup 62 is engaged with spline 78.

First housing 42, when rotated counterclockwise, causes legs 56 to slide in an axial direction from proximal to distal due to the relative movement to cam surface 68. Cup 62 is prevented from rotating counterclockwise due to compliant member 84 connecting tooth 82 to the cup 62. The counterclockwise rotation of first housing 42 causes the first housing to follow a helical path moving in a proximal to distal axial direction. When cup 62 has only one cam surface 68, first housing 42 has the freedom to rotate less than one rotation until legs 56 come to a stop at vertical step 74. Further counterclockwise rotation is prevented as the torque applied by the user to rotate the head is transmitted from first housing 42 to legs 56, then to vertical step 74, then to compliant member 84, then to the tooth 82, then to internal spline 78, thus preventing further rotation.

This structure and process described above provides that first housing 42 always remains within one pitch of the thread of being fully engaged with the body thread thus maintaining the integrity of the strength of the threaded assembly of the head to body.

Other embodiments are within the claims.

What is claimed is:

1. A light-emitting product, comprising a first housing including a light source for emitting light fixed in position within the first housing, a reflector fixed in position within the first housing, and a lens system that is adjustable in position relative to the light source and the reflector, the lens system including an arm element that positions a lens in front of the light source, and a second housing that can be attached to the first housing and including a power source for the light source, wherein when the first housing and the second housing are attached the first housing and the second housing can be moved relative to each other to adjust the position of the lens system relative to the position of the light source to focus the light from the light source.

2. The light-emitting product of claim 1, wherein the first housing includes a first threaded surface and the second housing includes a second threaded surface that can engage with the first threaded surface, the first and second threaded surfaces allowing the first housing to be attached to the second housing and also allowing the first housing and the second housing to be moved relative to each other after the attachment to adjust the position of the lens relative to the position of the light source to focus the light from the light source.

3. The light-emitting product of claim 1, wherein when the first housing is attached to the second housing and the first housing is moved relative to the second housing, the arm element is moved to provide the adjustment of the position of the lens to focus the light from the light source.

4. The light-emitting product of claim 3, wherein the lens system is spring loaded in the first housing.

5. The light-emitting product of claim 3, wherein the arm element is mounted in a cam ring and the second housing includes a cam surface which contacts the arm element when the first housing and the second housing are rotated relative to each other to provide the adjustment of the position of the lens system to focus the light from the light source.

6. The light-emitting product of claim 5, wherein the adjustment is provided within no more than about one full rotation of the first housing relative to the second housing.

7. The light-emitting product of claim 1, wherein the light source comprises a light emitting diode.

8. The light-emitting product of claim 1, wherein the light source comprises an incandescent bulb.

9. The light-emitting product of claim 1, wherein the power source comprises a battery.

10. The light-emitting product of claim 9, wherein the second housing is elongated and includes a surface that can be gripped, and wherein the light-emitting product includes a mechanism for turning the light source on and off.

11. The light-emitting product of claim 1, wherein the power source is an AC power source.

12. The light-emitting product of claim 1, wherein the first housing further includes a heat sink.

13. The light-emitting product of claim 12, wherein the light source is mounted on the heat sink.

14. The light-emitting product of claim 1, wherein the lens is mounted in alignment along an axis with the light source and the position of the lens is adjusted along the axis to focus the light from the light source.

15. The light-emitting product of claim 1, wherein the lens system includes more than one of the arm elements.

16. The light-emitting product of claim 1, wherein the arm element extends from behind the light source to the lens.

17. A light-emitting product, comprising a first housing including a light source for emitting light fixed in position within the first housing and a lens system that is adjustable in position relative to the light source, the lens system including an arm element that positions a lens in front of the light source, and a second housing that can be attached to the first housing and including a power source for the light source, wherein when the first housing and the second housing are attached the first housing and the second housing can be moved relative to each other to adjust the position of the lens system relative to the position of the light source to focus the light from the light source.

18. The light-emitting product of claim 17, wherein the first housing includes a first threaded surface and the second housing includes a second threaded surface that can engage with the first threaded surface, the first and second threaded surfaces allowing the first housing to be attached to the second housing and also allowing the first housing and the second housing can be moved relative to each other after the attachment to adjust the position of the lens relative to the position of the light source to focus the light from the light source.

19. The light-emitting product of claim 17, wherein when the first housing is attached to the second housing, and the first housing and the second housing are moved relative to each other, the arm element is moved to provide the adjustment of the position of the lens to focus the light from the light source.

20. The light-emitting product of claim 19, wherein the lens system is spring loaded in the front housing.

21. The light-emitting product of claim 19, the first housing further comprising a heat sink on which the light source is mounted.

22. The light-emitting product of claim 19, wherein the light source comprises a light-emitting diode.

23. The light-emitting product of claim 17, wherein the lens system includes more than one of the arm elements.

24. The light-emitting product of claim 17, wherein the arm element extends from behind the light source to the lens.

25. A housing for a light-emitting product, comprising a first housing including a light source for emitting light fixed in position within the first housing and a lens system that is adjustable in position relative to the light source, the lens system including an arm element that positions a lens in front of the light source, the first housing being designed for attachment to a second housing that includes a power source for the light source and, after attachment, for the first housing and the second housing to be moved relative to each other to adjust the position of the lens relative to the position of the light source to focus the light from the light source.

26. The housing of claim 25, wherein the first housing further includes a reflector fixed in position within the first housing.

27. The housing of claim 25, wherein the first housing includes a first threaded surface that can engage the second threaded surface in the second housing.

28. The housing of claim 25, wherein when the first housing is attached to the second housing, and the first housing and the second housing are moved relative to each other, the arm element is moved to provide the adjustment of the position of the lens system to focus the light from the light source.

29. The housing of claim 25 the first housing further comprising a heat sink on which the light source is mounted.

30. The housing of claim 25 wherein the light source comprises a light emitting diode.

31. The housing of claim 25, wherein the lens system includes more than one of the arm elements.

32. The housing of claim 25, wherein the arm element extends from behind the light source to the lens.

* * * * *

UNITED STATES PATENT AND TRADEMARK OFFICE

CERTIFICATE OF CORRECTION

PATENT NO. : 8,215,790 B2
APPLICATION NO. : 12/960594
DATED : July 10, 2012
INVENTOR(S) : Bryan L. Hesse et al.

It is certified that error appears in the above-identified patent and that said Letters Patent is hereby corrected as shown below:

Col. 6, Line 6, In Claim 5, before "to" delete "system".

Col. 6, Line 64, In Claim 20, delete "front" and insert --first--, therefor.

Col. 6, Line 65, In Claim 21, delete "19," and insert --19, wherein--, therefor.

Col. 8, Line 10, In Claim 28, after "lens" delete "system".

Col. 8, Line 11, In Claim 29, delete "25" and insert --25, wherein--, therefor.

Signed and Sealed this
Fourth Day of September, 2012

David J. Kappos

David J. Kappos
*Director of the United States Patent and Trademark Office*